US007168379B2

(12) United States Patent
Okazaki et al.

(10) Patent No.: US 7,168,379 B2
(45) Date of Patent: Jan. 30, 2007

(54) SEWING MACHINE

(75) Inventors: Yoshiyuki Okazaki, Aichi (JP); Kuniharu Miyake, Aichi (JP); Hidetaka Inagaki, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 56 days.

(21) Appl. No.: 10/669,551

(22) Filed: Sep. 25, 2003

(65) Prior Publication Data

US 2004/0060492 A1 Apr. 1, 2004

(30) Foreign Application Priority Data

Sep. 26, 2002 (JP) ..... 2002-280377

(51) Int. Cl.
*D05B 39/00* (2006.01)

(52) U.S. Cl. ..... 112/470.14

(58) Field of Classification Search ..... 112/470.14, 112/470.18, 63, 103, 470.09, 309, 318
See application file for complete search history.

(56) References Cited

U.S. PATENT DOCUMENTS

| | | | | |
|---|---|---|---|---|
| 3,650,231 | A * | 3/1972 | Tinari et al. | 112/260 |
| 4,665,844 | A * | 5/1987 | Shibata | 112/103 |
| 4,730,566 | A | 3/1988 | Brophy et al. | |
| 5,911,183 | A * | 6/1999 | Goto | 112/103 |
| 6,019,053 | A | 2/2000 | Kawaguchi | |

FOREIGN PATENT DOCUMENTS

| | | |
|---|---|---|
| EP | 0 175 565 A1 | 3/1986 |
| JP | A-61-179188 | 8/1986 |
| JP | A-62-170571 | 7/1987 |
| JP | B2-63-64993 | 12/1988 |
| JP | A-04-364887 | 12/1992 |
| JP | B2-2623239 | 4/1997 |
| JP | 10-273872 | 10/1998 |
| JP | B2-3149136 | 1/2001 |

* cited by examiner

*Primary Examiner*—Danny Worrell
(74) *Attorney, Agent, or Firm*—Oliff & Berridge, PLC

(57) ABSTRACT

A sewing machine includes a cylinder bed extending in a predetermined direction and accommodating a shuttle and a shuttle shaft for driving the shuttle, a cloth holding frame for holding a work cloth, a moving member for supporting the cloth holding frame, the moving member being guided by the shuttle shaft so as to be moved in the predetermined direction, and a moving member driving unit for driving the moving member in the predetermined direction.

9 Claims, 8 Drawing Sheets

SEWING MACHINE

BACKGROUND OF THE INVENTION

1. Field of the Invention

This invention relates generally to sewing machines and more particularly to a sewing machine with a cloth holding frame holding a work cloth and guided so as to be moved in a predetermined direction.

2. Description of the Related Art

There have conventionally been provided sewing machines in which a cloth holding frame holding a work cloth is moved back and forth or right and left, or turned about a rotational axis so that the work cloth is moved to a predetermined position thereby to be sewn. This type of sewing machine requires a member for guiding the cloth holding frame so that the frame is moved back and forth or left and right, or turned. For example, JP-A-10-273872 discloses a sewing machine including a drive ring to which a cloth holding frame for holding a work cloth such as a cap is mounted. The drive ring is turnable about a rotational axis extending in a back-and-forth direction. The drive ring is guided by a guide shaft provided below a cylinder bed. In this sewing machine, the drive ring is moved back and forth along the guide shaft so that the work cloth is moved back and forth.

In the aforesaid sewing machine, however, the guide shaft guiding the cloth holding frame mounted to the drive ring is disposed outside the cylinder bed. Accordingly, a space is required in which the guide shaft is disposed outside the cylinder bed. The space increases the size of the sewing machine. Furthermore, since the guide shaft is separately disposed outside the cylinder bed, the number of components of the sewing machine is increased. This complicates the structure of the sewing machine and is disadvantageous in the production cost.

SUMMARY OF THE INVENTION

Therefore, an object of the present invention is to provide a sewing machine in which a size reduction can be achieved by compacting the construction for guiding the cloth holding frame so that the frame is moved in a predetermined direction and the construction for guiding the cloth holding frame can be simplified.

The present invention provides a sewing machine comprising a cylinder bed extending in a predetermined direction and accommodating a shuttle and a shuttle shaft for driving the shuttle, a cloth holding frame for holding a work cloth, a moving member for supporting the cloth holding frame, the moving member being guided by the shuttle shaft so as to be moved in the predetermined direction, and a moving member driving unit for driving the moving member in the predetermined direction.

In the sewing machine thus constructed, a work cloth is attached to the cloth holding frame supported on the moving member. When the moving member is driven in the predetermined direction by the moving member driving unit during sewing, the moving member is moved in the predetermined direction while being guided by the shuttle shaft accommodated in the cylinder bed. With movement of the moving member, the work cloth held on the cloth holding frame is also moved in the predetermined direction. Consequently, the construction for guiding the cloth holding frame so that the frame is moved in the predetermined direction can be compacted.

In a preferred form, the cloth holding frame is pivotally mounted on the moving member. In this case, the sewing machine preferably further comprises a rotation limiting member for limiting rotation of the moving member relative to the shuttle shaft. Furthermore, the rotation limiting member is preferably disposed outside or inside the cylinder bed.

Additionally, the sewing machine preferably further comprises a pillar portion from which the cylinder bed extends horizontally. In this construction, the cylinder bed is used for sewing a cylindrical work and formed into a cylindrical shape and has an inner void.

BRIEF DESCRIPTION OF THE DRAWINGS

Other objects, features and advantages of the present invention will become clear upon reviewing the following description of the embodiment, made with reference to the accompanying drawings, in which.

DETAILED DESCRIPTION OF THE INVENTION

An embodiment of the present invention will be described with reference to FIGS. 1 to 5. In the embodiment, the invention is applied to a household embroidery machine which can sew various embroidery patterns on a cylindrical or annular work cloth forming a sleeve of clothing. In the following description, a user confronts the embroidery machine at the left side as viewed in FIG. 1. Accordingly, a left-hand part of the embroidery machine as viewed in FIG. 1 is regarded as the front throughout the description.

Figure 1:
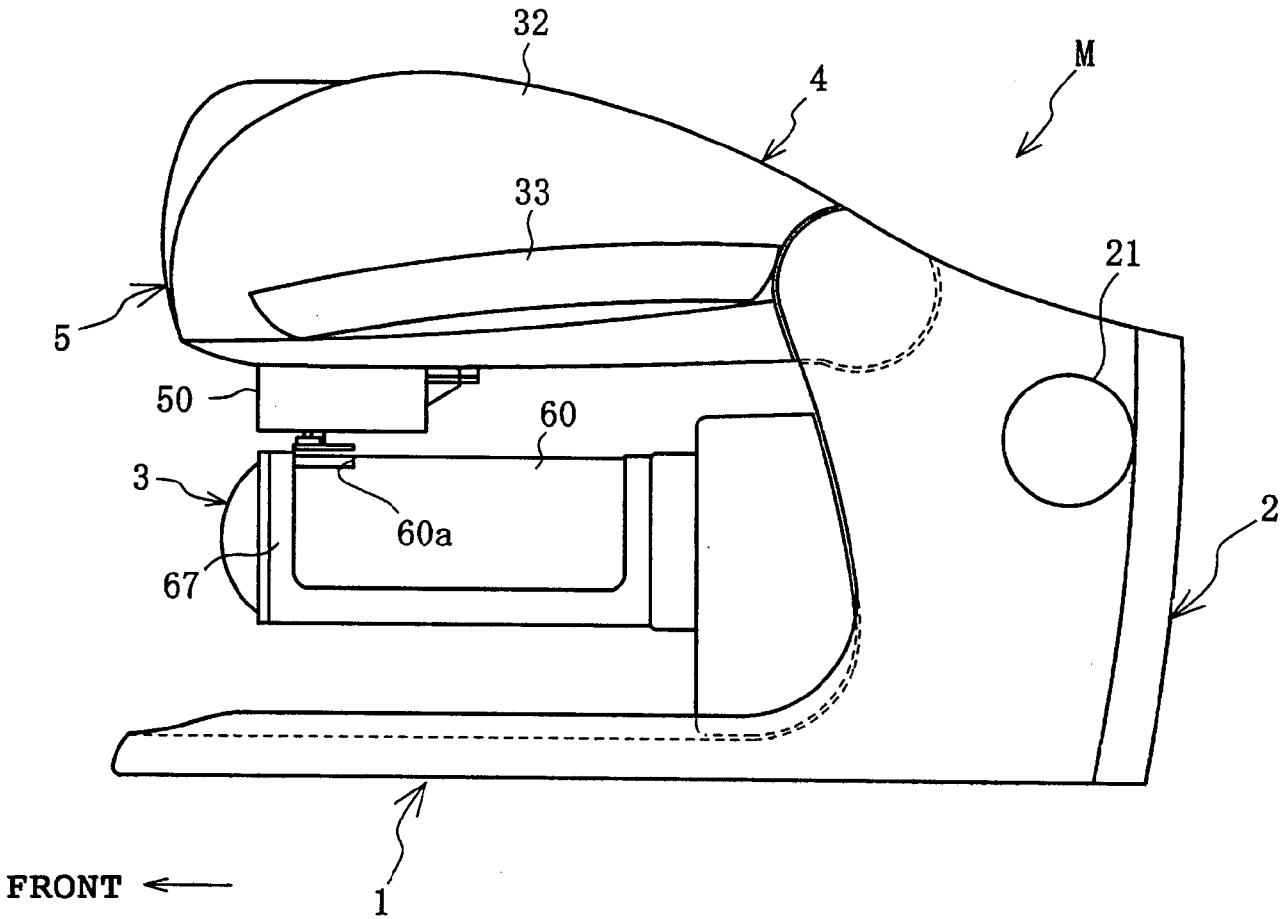
FIG. 1 is a side view of an embroidery machine of an embodiment in accordance with the present invention.
Figure 2:
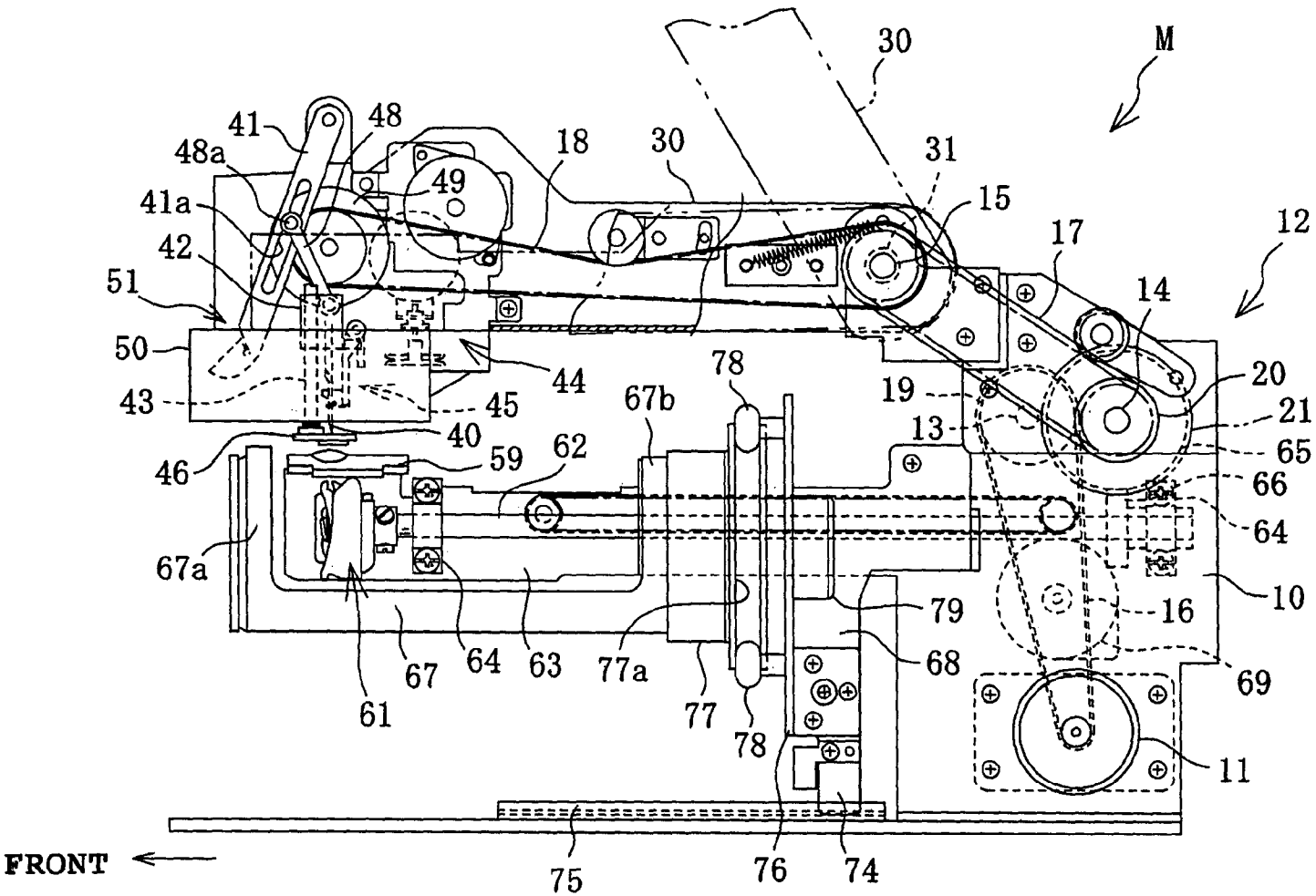
FIG. 2 is side view of the embroidery machine, showing inner mechanisms.
Figure 3:
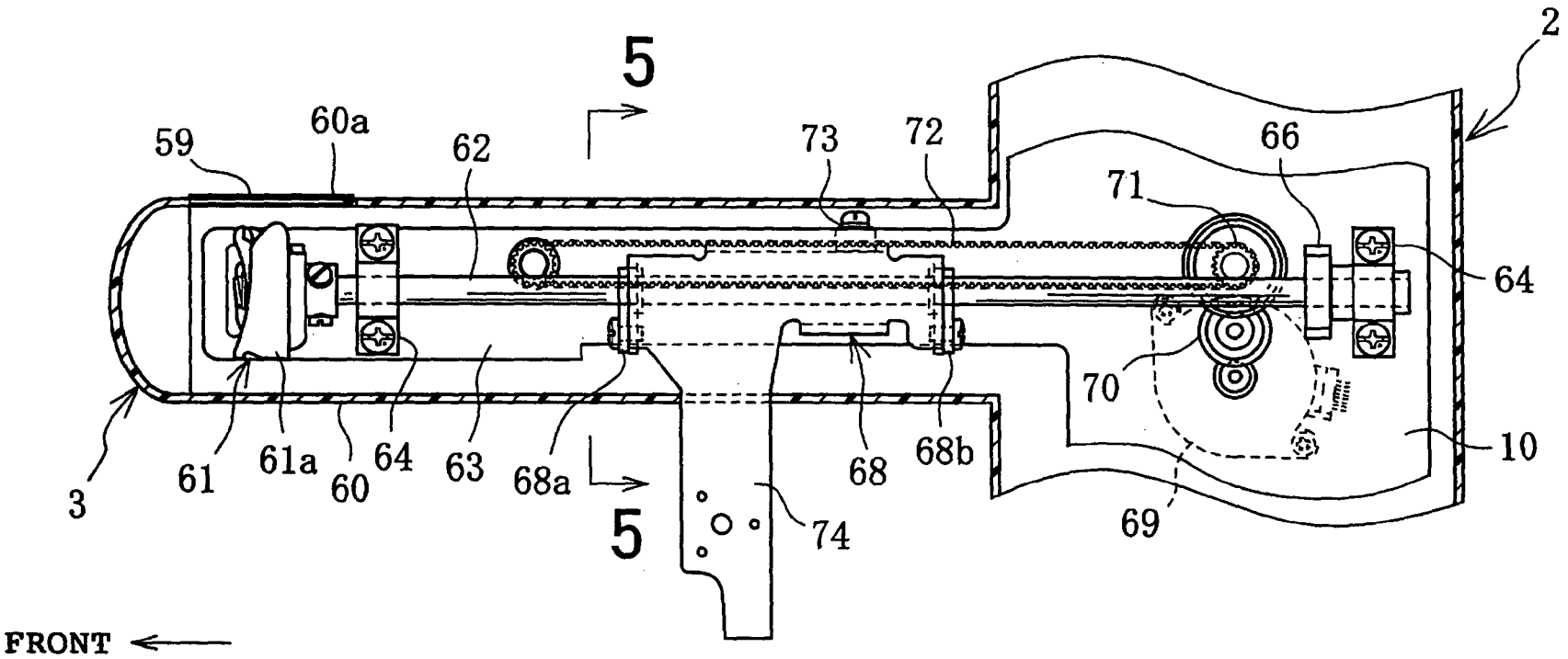
FIG. 3 is a side view of the inner mechanism of a cylinder bed of the embroidery machine.
Figure 4:
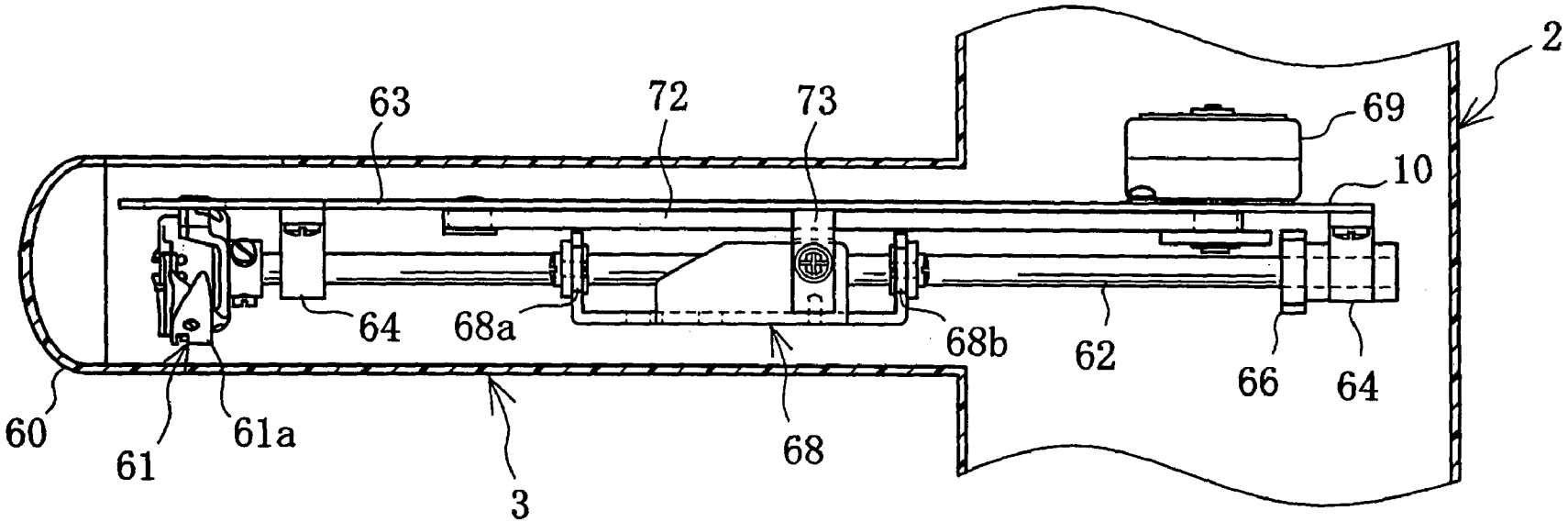
FIG. 4 is a plan view of the inner mechanism of the cylinder bed.
Figure 5:
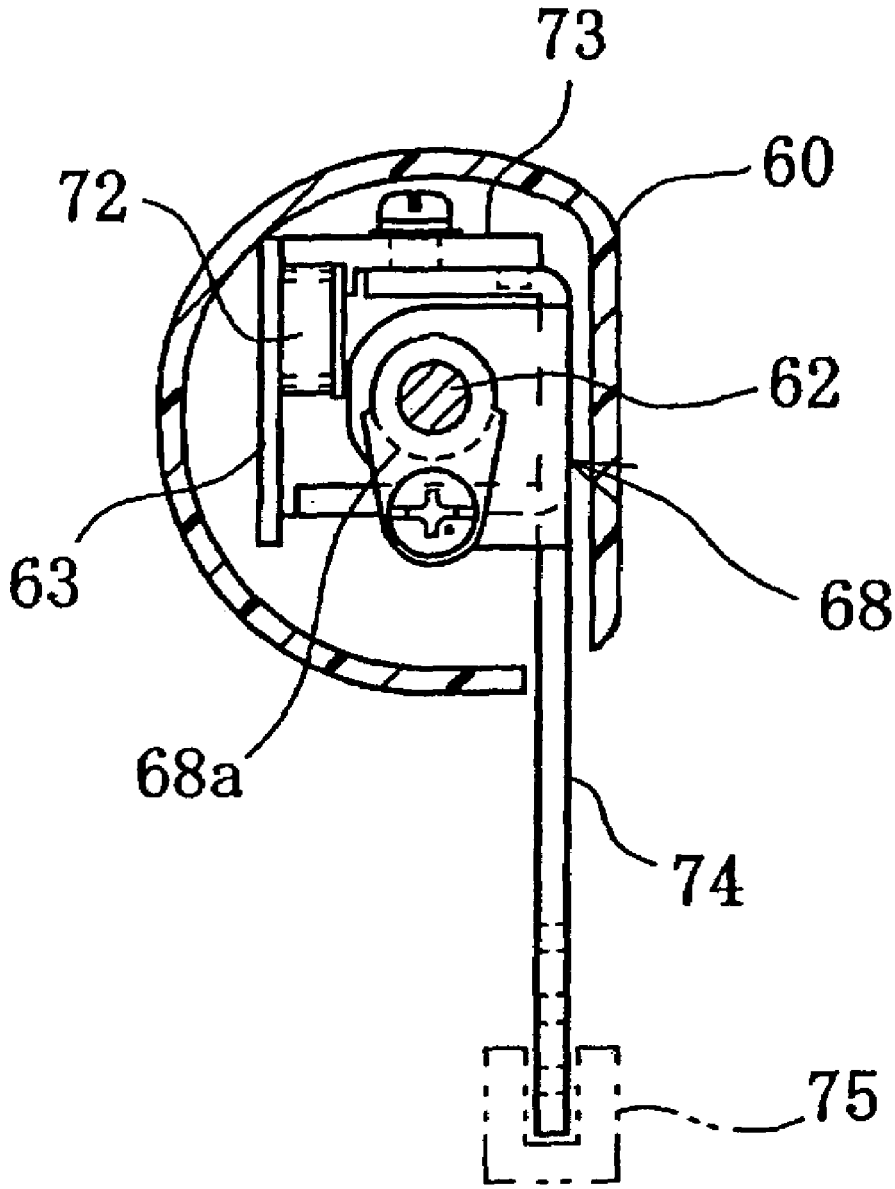
FIG. 5 is a view taken along line 5—5 in FIG. 3.

Referring to FIGS. 1 and 2, the embroidery machine M includes a horizontal base 1, a pillar section 2 standing from a rear end of the base 1, a cylinder bed 3 extending horizontally toward the front from the pillar section 2, an arm 4 supported on an upper end of the pillar section 2 so as to be displaceable between a sewing position where the arm extends horizontally toward the front as shown by solid line in FIG. 2 and a retreat position where the arm is retreated upward as shown by chain line in FIG. 2, and a head 5 provided on a front end of the arm 4.

The user sets a cylindrical work cloth on a cloth holding frame 67 to be fitted with the cylinder bed 3 before start of sewing. A sewing needle 40, a threading mechanism 45 and the like provided on the head 5 may possibly interrupt the user setting the work cloth. In order that the user may readily set the work cloth, the arm 4 is switched from the sewing position to the retreat position. After the work cloth is set on the cloth holding frame 67 while the arm 4 is at the retreat position, the arm is re-switched to the sewing position. In this state, the sewing operation is carried out for the work cloth.

The pillar 2 has a body frame 10 on which a sewing machine motor 11 and main components of a driving force transmission mechanism 12 are provided. The transmission mechanism 12 transmits a driving force of the motor 11 to a sewing needle 40, a needle thread take-up 41 and the like provided in the head 5. The transmission mechanism 12 comprises a spindle 14, transmitting shafts 13 and 15, belts 16, 17 and 18, gears 19 and 20. The driving force produced by the motor 11 is transmitted via the belt 16 to the transmitting shaft 13. The driving force transmitted to the shaft 13 is further transmitted via the gears 19 and 20 to the spindle 14. The driving force is further transmitted via the belt 17 to the shaft 15 and further via the belt 18 to the needle 40 and needle thread take-up 41. Furthermore, a pulley 21 is mounted on the spindle 14. When the spindle 14 is manually turned, the resultant driving force is transmitted via the pulley 21 to the needle 40 so that the needle is vertically moved. The above-mentioned components of the transmitting mechanism 12 are dispersed in the axial direction of the spindle 14 and shafts 13 and 15.

The arm 4 includes an arm frame 30 having a rear end fitted with a pair of bearings 31 so that the arm frame is rotatively slid. The arm 4 is rotatable between a sewing position shown by solid line in FIG. 2 and a retreat position shown by chain line in FIG. 2. An arm cover 32 (see FIG. 1) covering the arm 4 is formed with a protrusion 33 protruding horizontally rightward. A liquid crystal display (not shown) is provided on a top of the protrusion 33. The liquid crystal display includes a touch panel provided on an upper side thereof. The touch panel is provided with various operation keys such as a pattern selecting key for selecting an embroidery pattern. The protrusion 33 is slightly inclined frontward downward in order that the user may operate the touch panel easily.

On the head 5 are provided the sewing needle 40 and the needle thread take-up 41 supported on the arm frame 30 to be rocked back and forth. Furthermore, the head 5 includes a needle clamp 42 holding the needle 40 and a guide shaft 43 guiding the needle clamp moved vertically. Additionally, the head 5 includes a thread tensioning mechanism 44 adjusting a tension of a needle thread, a threading mechanism 45 for passing the needle thread through an eye of the needle 40 and a presser foot 46 provided on a lower end of the guide shaft 43 for pressing the work cloth from above.

The needle thread take-up 41 has a lengthwise formed guide groove 41*a*. A link member 48 is connected to the needle clamp 42 and has a pin 48*a* provided on an upper end thereof. The link member 48 is connected via the pin 48*a* to a rotating plate 49. Accordingly, the rotating plate 49 is rotated when a driving force produced by the motor 11 is transmitted from the transmitting shaft 15 via the belt 18 to the rotating plate. With rotation of the plate 49, the link member 48 is vertically moved so that the needle clamp 42 and needle 40 are also vertically moved while being guided by the guide shaft 43. Simultaneously, the needle thread take-up 41 is rocked back and forth in synchronization with the link member 48.

The presser foot 46 includes a cutter (not shown) for severing the needle thread. For example, when a needle thread with one color is changed from another needle thread with another color, a cloth holding frame 67 which will be described later is driven rearward by a drive motor 69 while being pivoted by a drive motor 79. Consequently, the needle thread between the cloth holding frame 67 and the needle eye is moved to the cutter to be thereby severed by the cutter.

The head 5 is provided with a cassette mount 51 to which a thread cassette 50 is attached. The thread cassette 50 accommodates a thread spool serving as a supply of thread. When the thread cassette 50 is attached to the cassette mount 51, the threading mechanism 45 is operated in synchronization with attachment of the thread cassette to the cassette mount, so that the needle thread is passed through an eye of the needle 40. Furthermore, the needle thread take-up 41 and the thread tensioning mechanism 44 are threaded in synchronization with attachment of the thread cassette to the cassette mount.

The cylinder bed 3 will now be described. The cylinder bed 3 includes a cylindrical cover 60 made of a synthetic resin and extending back and forth as shown in FIGS. 1 to 4. The cover 60 has a cut-out hole 60*a* formed in a front top thereof. A needle plate 59 is mounted to the cut-out hole 60*a*. The cylinder bed 3 encloses a vertical shuttle 61 and a shuttle shaft 62 turning an outer shuttle 61*a* of the vertical shuttle. The needle plate 59 is provided on an upper portion of the vertical shuttle 61. The needle plate 59 has a through hole through which the needle 40 is passed. When the needle 40 is lowered through the hole of the needle plate 59, the needle thread is caught on a pointed end of the outer shuttle 61*a* such that the needle thread and a bobbin thread are entangled together, whereby stitches are formed on the work cloth located at the upper side of the needle plate 59.

A vertical plate-shaped shuttle shaft supporting frame 63 is provided on the left of the shuttle shaft 62 extending in the back-and-forth direction. The supporting frame 63 extends frontward from the body frame 10 in parallel to the shuttle shaft 62. The shuttle shaft 62 is rotatably supported on a pair of bearings 64 provided on the frame 63 and the body frame 10 respectively. A driving force produced by the motor 11 is transmitted from the spindle 14 via the gears 65 and 66 to the shuttle shaft 62, so that the outer shuttle 61*a* is rotated.

A cloth holding frame 67 for holding the work cloth is fitted with a front half of the cylinder bed 3 so as to be slid, as shown in FIGS. 1 and 2. The cloth holding frame 67 has front and rear ends formed with a pair of cloth holding portions 67*a* and 67*b* respectively. The work cloth is pressed by a cloth presser (not shown) against the cloth holding frame 67 from above so as to be held on the cloth holding portions 67*a* and 67*b*. A moving member 68 supporting the cloth holding frame 67 is provided on a rear half of the cylinder bed 3 so as to be moved in the back-and-forth direction relative to the cylinder bed. The moving member 68 has front and rear ends formed with a pair of guided portions 68*a* and 68*b* through which the shuttle shaft 62 extends, respectively. The moving member 68 is guided at the guided portions 68*a* and 68*b* so as to be moved in the back-and-forth direction relative to the shuttle shaft 62. A driving motor 69 (serving as a moving member driving unit) is provided for driving the moving member 68 in the back-and-forth direction. The driving motor 69 comprises a pulse motor and is mounted on the body frame 10 so as to be located over the sewing machine motor 11.

A driving force produced by the driving motor 69 is transmitted via two gears 70 and 71 to a belt 72 extending from a middle portion of the frame 63 to the body frame 10. The belt 72 is connected by a belt connecting member 73 to the moving member 68. The belt connecting member 73 is screwed to the moving member 68. Accordingly, the driving force is transmitted from the belt 72 to the moving member 68 so that the moving member is driven in the back-and-forth direction.

The moving member 68 has a protrusion 74 formed integrally therewith. The protrusion 74 extends downward through the cylinder bed 3. A generally rail-like rotation limiting member 75 made of a synthetic resin is provided on the upper side of the base 1 so as to extend in the back-and-forth direction. The protrusion 74 engages the rotation limiting member 75 so as to be allowed to slide in the back-and-forth direction but disallowed to move in a left-and-right direction. Consequently, rotation of the moving member 68 relative to the shuttle shaft 62 is limited by the rotation limiting member 75. In order that the moving member 68 may be moved smoothly in the back-and-forth direction, a certain gap is required between the moving member and the rotation limiting member 75. However, since the rotation limiting member 75 is disposed outside the cylinder bed 3, a distance between each guided portion 68*a*, 68*b* of the moving member 68 and the rotation limiting member 75 is increased. As a result, shaking of the moving member 68 due to the aforesaid gap can be reduced and the moving member can be prevented from being excessively inclined relative to the base 1.

Figure 6:
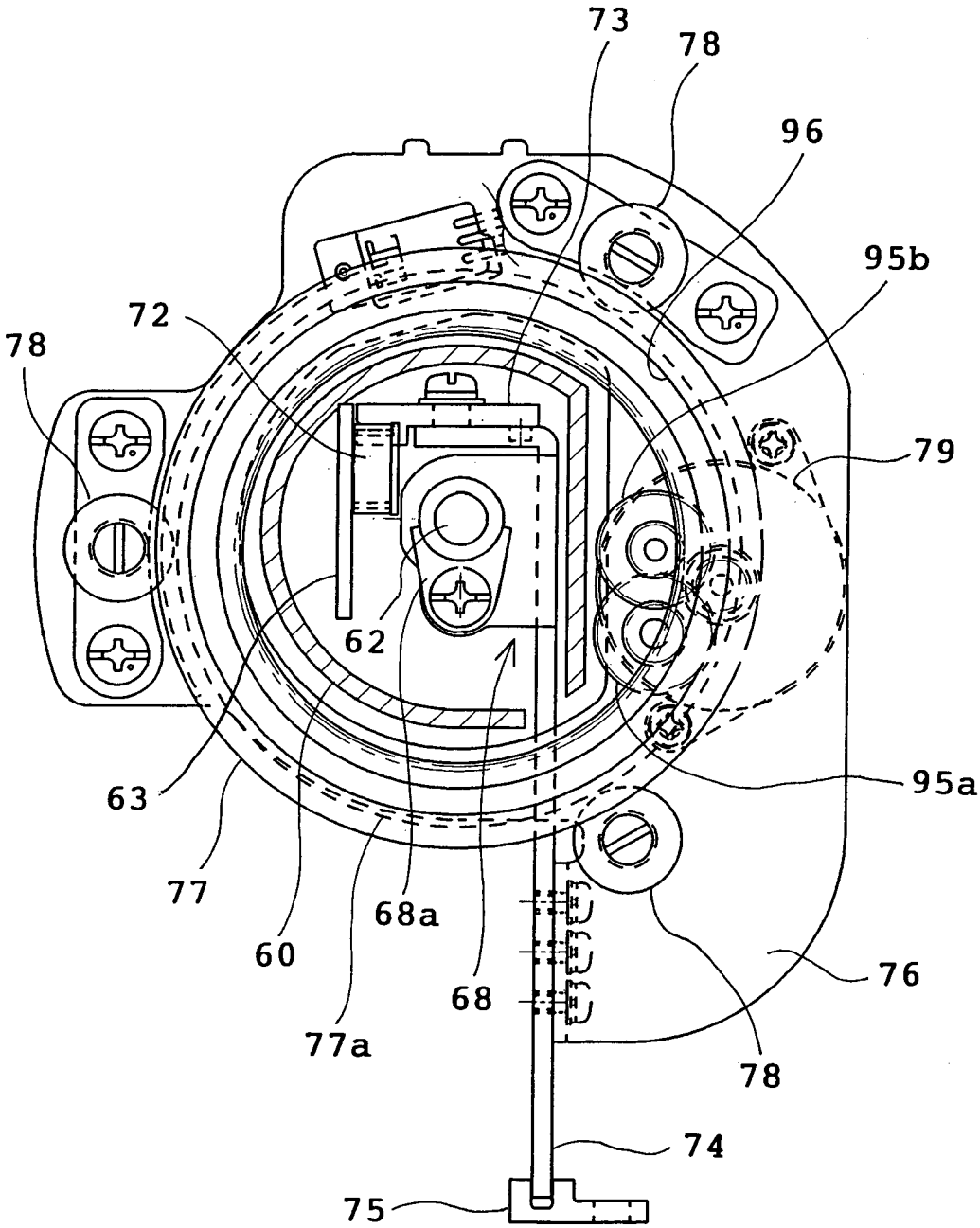
FIG. 6 is a view similar to FIG. 3, showing the embroidery machine of another embodiment in accordance with the invention.

A mounting plate portion 76 is provided integrally on the front end of the moving member 68 as shown in FIGS. 2 and 6. An annular drive ring 77 is mounted on the mounting plate portion 76 so as to pivot about the axis of rotation extending in the back-and-forth direction relative to the moving member 68. The drive ring 77 has a front end on which the cloth holding frame 67 is mounted so as to be integral therewith. The drive ring 77 has an annular groove 77*a* formed in an outer periphery thereof. The annular groove 77*a* engages a plurality of, for example, three, rollers 78 fixedly provided on the mounting plate portion 76 of the moving member 68. The drive ring 77 is rotated relative to the moving member 68 while being guided by the rollers 78. An electric motor 79 for driving the drive ring 77 comprises a pulse motor. The driving motor 79 is mounted on the rear of the mounting plate portion 76. Two gears 95*a* and 95*b* (see FIG. 6) are provided inside the drive ring 77. A gear 96 (see FIG. 6) is formed on the inner periphery of the drive ring 77. A driving force produced by the driving motor 79 is transmitted via the gears 95*a*, 95*b* and 96 to the drive ring 77.

An amount of back-and-forth movement of the moving member 68 by the driving motor 69 is determined on the basis of embroidery data previously read from a recording medium such as a flexible disc or memory card. An amount of rotative movement of the drive ring 77 by the driving motor 79 is also determined on the basis of the embroidery data previously read from the recording medium such as the flexible disc or memory card. When the moving member 68 is driven in the back-and-forth direction by the driving motor 69 by the movement amount determined as described above, the cloth holding frame 67 supported on the drive ring 77 further supported on the moving member 68 is also moved in the back-and-forth direction by the determined movement amount. In the same way, when the drive ring 77 is driven by the rotative movement amount determined as described above by the driving motor, the cloth holding frame 67 mounted on the drive ring 77 is also driven by the determined rotative movement amount.

The embroidery machine M operates as follows. Firstly, when a work cloth is set on the cloth holding frame 67 before sewing, the arm 4 is switched from the sewing position as shown by solid line in FIG. 2 to the retreat position as shown by chain line in FIG. 2 in order that the user may set the work cloth on the frame readily. Thereafter, the arm 4 is returned to the sewing position when the work cloth has been set on the frame 67 by the user.

When the sewing starts in the above-described condition, the moving member 68 is moved in the back-and-forth direction by the predetermined movement amount by the driving motor 69, so that the cloth holding frame 67 is also moved in the back-and-forth direction. Alternatively, the drive ring 77 is driven by the predetermined rotative movement amount by the driving motor 79 so that the cloth holding frame 67 is rotated, whereby an embroidery pattern is formed on the work cloth. In this case, when the moving member 68 supporting the cloth holding frame 67 is moved in the back-and-forth direction, the moving member is guided on the guided portions 68*a* and 68*b* by the shuttle shaft 62 in the back-and-forth direction while rotation of the moving member relative to the shuttle shaft is limited by the rotation limiting member 75.

The moving member 68 supporting the cloth holding frame 67 is guided by the shuttle shaft 62 accommodated in the cylinder bed 3, so as to be moved in the back-and-forth direction. Accordingly, no separate member for guiding the moving member 68 is required to be provided outside the cylinder bed 3. Thus, since no space for disposition of such a guiding member is required, a size reduction can be achieved in the embroidery machine M. Furthermore, the number of components of the embroidery machine M can be reduced and the construction for guiding the moving member 68 can be simplified. Consequently, the above-described construction of the embroidery machine M has a cost advantage.

Even if the moving member 68 should be rotated relative to the shuttle shaft 62, the cloth holding frame 67 would be displaced from the predetermined position thereof. However, since the rotation of the moving member 68 relative to the shuttle shaft 62 is limited by the rotation limiting member 75 in the above-described embroidery machine M, the work cloth can reliably be held at a predetermined sewing position. Furthermore, since the rotation limiting member 75 is disposed outside the cylinder bed 3, the distance is increased between each guided portion 68*a*, 68*b* of the moving member 68 and the rotation limiting member 75. Consequently, shaking of the moving member 68 due to the gap between the moving member and the rotation limiting member 75 can be reduced and the moving member can be prevented from being excessively inclined relative to the base 1.

Figure 7:
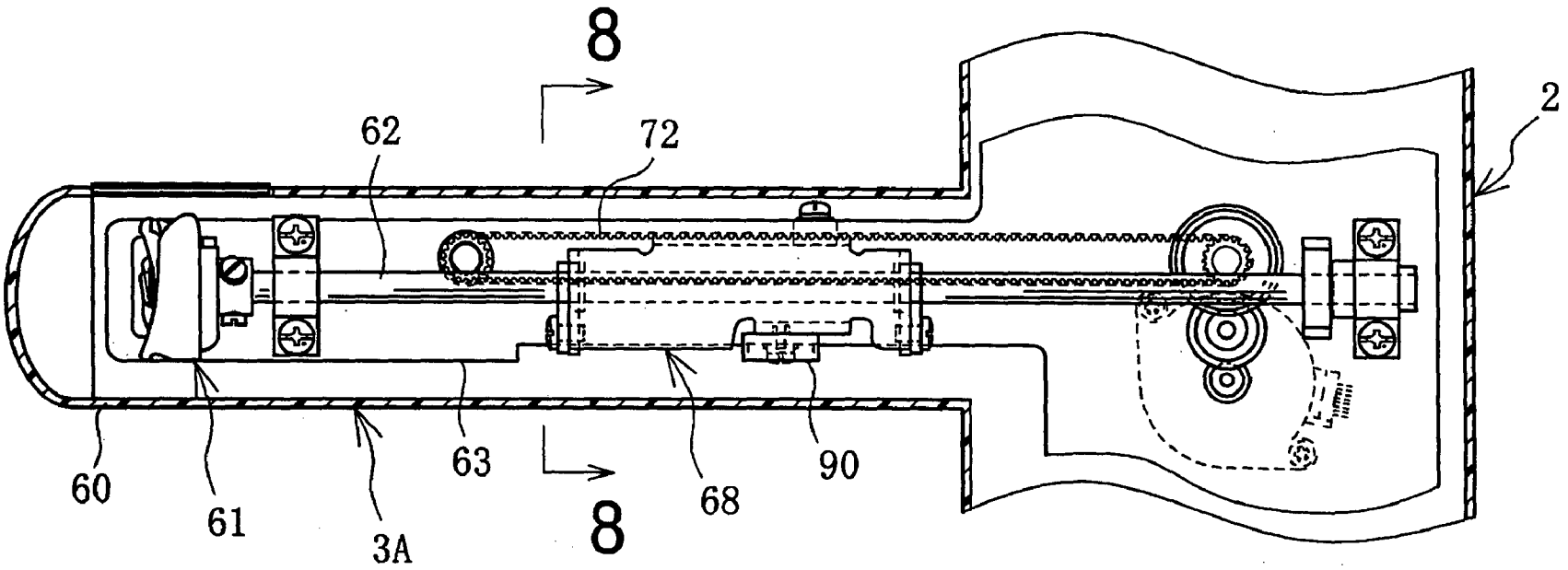
FIG. 7 is a view taken along line 7—7 in FIG. 6.
Figure 8:
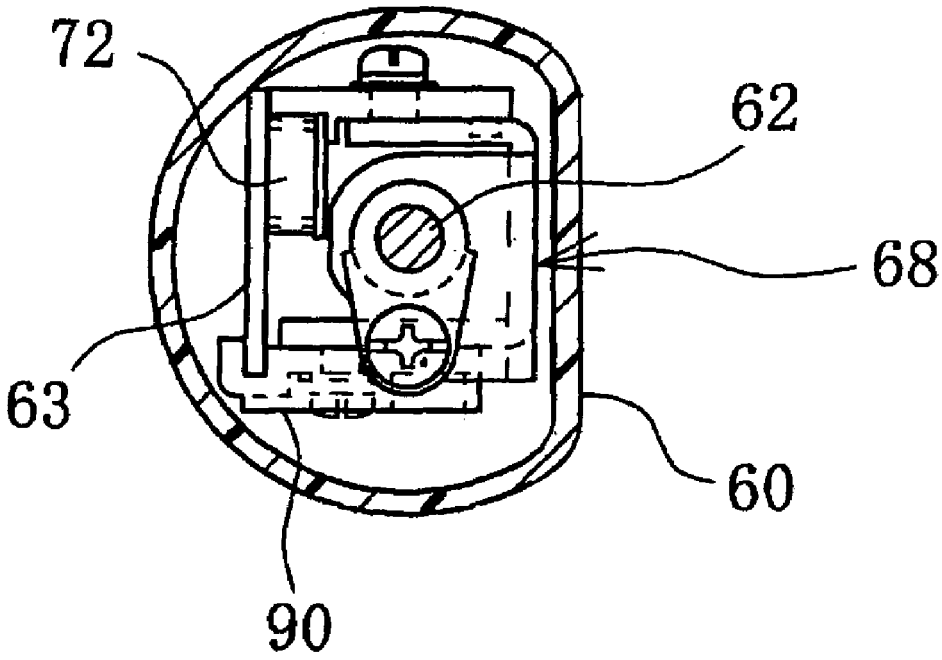
FIG. 8 is a view taken along line 8—8 in FIG. 7.

Several modified forms of the embodiment will now be described. Firstly, the rotation limiting member limiting rotation of the moving member 68 relative to the shuttle shaft 62 maybe disposed inside the cylinder bed. For example, as shown as a second embodiment in FIGS. 7 and 8, a sliding member 90 made of a synthetic resin is mounted on the moving member 68 inside the cylinder bed 3 so as to engage the lower end of the shuttle shaft supporting frame 63 and so as to be slid in the back-and-forth direction relative to the frame. As a result, the moving member 68 is guided in the back-and-forth direction by the shuttle shaft 62, and rotation of the moving member 68 relative to the shuttle shaft 62 is limited by the frame 63. Accordingly, the shuttle shaft supporting frame 63 serves as the rotation limiting member in the above construction.

Furthermore, a guide member guiding the moving member 68 in the back-and-forth direction may be provided inside the cylinder bed 3 so as to be separate from the shuttle shaft 62. The guide member may be shaft-shaped such as the shuttle shaft 62 or rail-like and a part of the moving member 68 may engage the rail-like guide member for relative movement in the back-and-forth direction. Thus, the guide member may be formed into various shapes. Additionally, the aforesaid shaft separate from the shuttle shaft 62 may be a drive shaft for driving another mechanism provided in the cylinder bed 3 such as a thread trimming mechanism, feed dog mechanism or bobbin thread take-up. The shuttle which is a thread loop capturing mechanism may be a horizontal shuttle as well as a vertical shuttle.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A sewing machine comprising:

a cylinder bed extending in a predetermined direction and accommodating a shuttle and a shuttle shaft for driving the shuttle;

a cloth holding frame for holding a work cloth;

a moving member for supporting the cloth holding frame, the moving member being guided by the shuttle shaft so as to be moved in the predetermined direction; and a moving member driving unit for driving the moving member in the predetermined direction.

2. A sewing machine according to claim 1, wherein the cloth holding frame is pivotally mounted on the moving member.

3. A sewing machine according to claim 2, further comprising a rotation limiting member for limiting rotation of the moving member relative to the shuttle shaft.

4. A sewing machine according to claim 3, wherein the rotation limiting member is disposed outside the cylinder bed.

5. A sewing machine according to claim 3, wherein the rotation limiting member is disposed inside the cylinder bed.

6. A sewing machine according to claim 1, further comprising a pillar portion from which the cylinder bed extends horizontally, wherein the cylinder bed is used for sewing a cylindrical work and formed into a cylindrical shape and has an inner void.

7. A sewing machine comprising:

a cylinder bed extending in a predetermined direction;

a cloth holding frame for holding a work cloth;

a moving member supporting the cloth holding frame and moved in the predetermined direction;

a moving member driving unit for driving the moving member in the predetermined direction;

a guiding member provided in the cylinder bed for guiding the moving member so that the moving member is moved in the predetermined direction; and a rotation limiting member for limiting rotation of the moving member relative to a shuttle shaft, wherein the cloth holding frame is pivotally supported on the moving member.

8. A sewing machine according to claim 7, wherein the rotation limiting member is disposed outside the cylinder bed.

9. A sewing machine according to claim 7, wherein the rotation limiting member is disposed inside the cylinder bed.

* * * * *